US005735697A

United States Patent [19]

Muzslay

[11] Patent Number: 5,735,697

[45] Date of Patent: Apr. 7, 1998

[54] SURFACE MOUNT CONNECTOR

[75] Inventor: Steven Zoltan Muzslay, Huntington Beach, Calif.

[73] Assignee: ITT Corporation, New York, N.Y.

[21] Appl. No.: 722,336

[22] Filed: Sep. 27, 1996

[51] Int. Cl.[6] ..... H01R 9/09

[52] U.S. Cl. ..... 439/83; 439/936

[58] Field of Search ..... 439/83, 936, 557, 439/76.1

[56] References Cited

U.S. PATENT DOCUMENTS

| | | | |
|---|---|---|---|
| 3,905,665 | 9/1975 | Lynch et al. | 439/62 |
| 3,977,075 | 8/1976 | Lynch et al. | 29/628 |
| 4,053,199 | 10/1977 | Hyllyday et al. | 439/83 |
| 4,173,387 | 11/1979 | Zell | 439/557 |
| 4,274,699 | 6/1981 | Keim | 439/637 |
| 4,391,482 | 7/1983 | Czeschka | 439/590 |
| 4,577,922 | 3/1986 | Stipanuk et al. | 439/629 |
| 4,678,250 | 7/1987 | Romine et al. | 439/83 |
| 4,726,793 | 2/1988 | Bright | 439/751 |
| 4,767,344 | 8/1988 | Noschese | 439/83 |
| 4,775,333 | 10/1988 | Grider et al. | 439/736 |
| 4,871,320 | 10/1989 | Mouissie | 439/78 |
| 4,927,372 | 5/1990 | Collier | 439/83 |
| 4,952,529 | 8/1990 | Grider | 437/209 |
| 4,978,308 | 12/1990 | Kanfmam | 439/83 |
| 5,015,192 | 5/1991 | Welsh et al. | 439/83 |
| 5,040,994 | 8/1991 | Nakamoto et al. | 439/76.1 |
| 5,104,324 | 4/1992 | Grabbe et al. | 439/62 |
| 5,242,311 | 9/1993 | Seong | 439/135 |
| 5,279,028 | 1/1994 | McKee et al. | 29/843 |
| 5,336,118 | 8/1994 | McKee et al. | 439/876 |
| 5,356,299 | 10/1994 | Kunishi et al. | 439/83 |
| 5,362,243 | 11/1994 | Huss et al. | 439/76.1 |
| 5,387,139 | 2/1995 | McKee et al. | 439/876 |
| 5,409,386 | 4/1995 | Banakis et al. | 439/83 |
| 5,421,752 | 6/1995 | McKee et al. | 439/876 |
| 5,451,174 | 9/1995 | Bogursky et al | 439/876 |

*Primary Examiner*—Neil Abrams
*Assistant Examiner*—T. C. Patel
*Attorney, Agent, or Firm*—Freilich Hornbaker & Rosen

[57] ABSTRACT

A connector is described which can be surface mounted to a rigid or flexible circuit board. The connector includes a plurality of contacts (36) fixed to a dielectric locator (42), with the lower ends (46) of the contacts soldered to the surfaces of contact pads formed along traces on the circuit board (14). After the contacts are soldered in place, a connector housing (72) is slid downwardly around the locator and the lower end of the housing is adhesively sealed by adhesive (70A) to the circuit board around the contacts. A potting compound (92) such as epoxy is then injected into the housing, to bond the circuit board to the contacts and to the inside surface (86) of the housing. The connector is inserted up into an aperture (16) in a rigid mounting wall (20) and mounted thereat, with the circuit board being supported on the connector and through it on the mounting wall.

10 Claims, 4 Drawing Sheets

SURFACE MOUNT CONNECTOR

BACKGROUND OF THE INVENTION

Automobiles are commonly provided with circuit boards lying within transmission housings, to carry and connect to sensors and to initially process signals (e.g. preamplify them). Signals are transmitted between the circuit board and a central microprocessor in the automobile through a connector that projects through an aperture in a transmission mounting wall. Previously, flexible wires extended from the connector to a circuit board. Such wires could be eliminated by connecting the connector contacts directly to traces on a circuit board. Prior art construction of connectors on circuit boards generally have involved forming the connector contacts so their tail ends project through plated-through holes in the circuit board. The cost of forming such plated-through holes greatly increases the cost of the circuit board, so surface mount contacts would be desirable. However, surface mount solder contacts often cannot reliably withstand forces that may be applied to the contacts during mating and unmating of connectors. An assembly which used surface mounting of connector contacts to surface board traces, in an arrangement that avoided the application of significant mating and unmating forces to the circuit board, would be of value.

SUMMARY OF THE INVENTION

In accordance with one embodiment of the present invention, a connector-board assembly is provided wherein contacts of a connector are surface soldered to traces on a circuit board, in an arrangement that avoids application of contact mating and unmating forces to the solder joints. A connector housing extends around the contacts, and a quantity of potting compound lies in the housing and is bonded to the inside walls of the housing, to the contacts, and to a portion of the circuit board. As a result, mating and unmating loads on the contacts are transmitted through the potting compound to the housing, rather than to the circuit board. Also, the circuit board is tightly held to the housing and rigidized against bending by the quantity of rigid potting material lying against it. The connector can be held by a rigid mounting wall, which supports at least a portion of the circuit board through the connector housing.

The contacts are initially projected through holes in a dielectric locator, to provide a subassembly consisting of the locator and connectors. A robot arm places dollops of solder paste on each contact pad of the circuit board, including those to be joined to the connector contacts, and others to be joined to active circuit components to be mounted on the circuit board. The subassembly is placed on the circuit board so each contact presses into a dollop of solder paste, and with active circuit components pressed against other dollops of solder paste, and the entire arrangement is reflow soldered. A loop of seal-adhesive is placed on the circuit board, and the connector housing is slid down around the locator until its lower end lies against the loop of adhesive, which is then cured. Potting compound such as epoxy is then injected into the space within the connector housing and around the contacts and locator, and against the upper face of the circuit board, to bond them all together.

The novel features of the invention are set forth with particularity in the appended claims. The invention will be best understood from the following description when read in conjunction with the accompanying drawings.

DESCRIPTION OF THE PREFERRED EMBODIMENT

Figure 1:
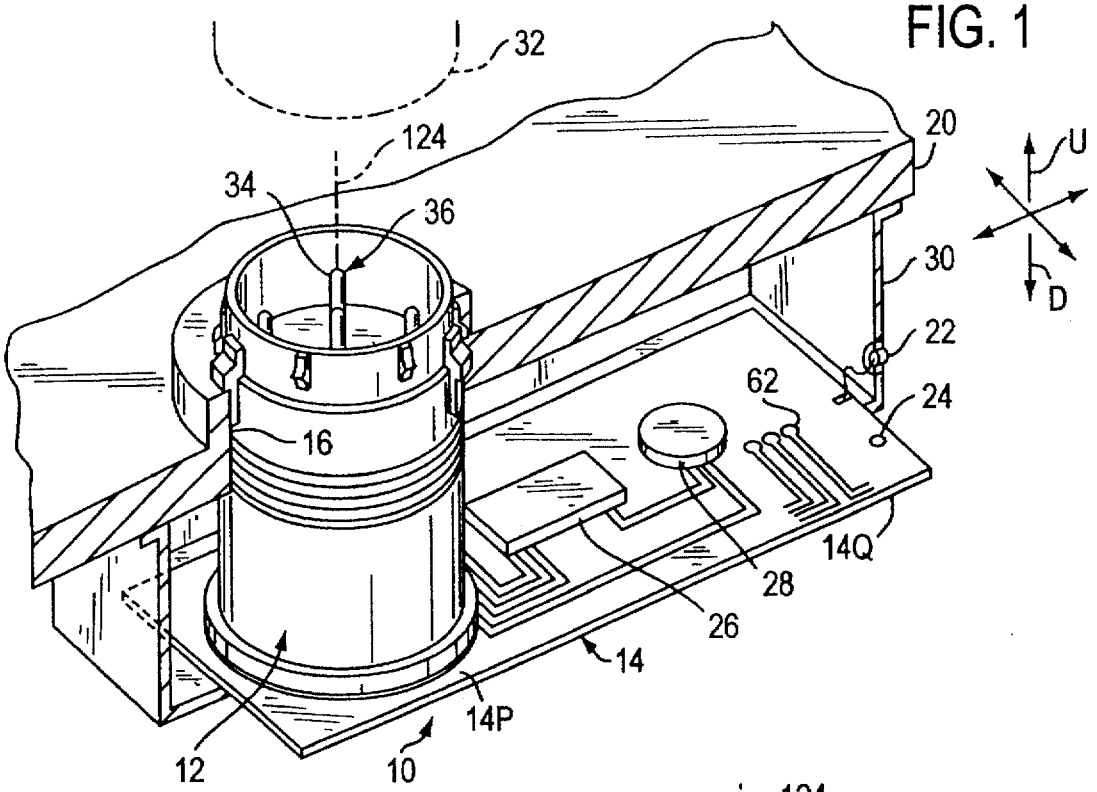
FIG. 1 is a sectional isometric view of a connector-board assembly shown mounted on a mounting wall, in accordance with the present invention.

FIG. 1 illustrates a connector board assembly 10 which includes an electrical connector 12 and a circuit board 14. The connector extends through a vertical aperture 16 in a rigid mounting wall 20, such as the housing of an automobile transmission. The circuit board 14 has a portion 14Q that holds and is connected to sensors 22, 24 that sense conditions in the transmission, and holds circuitry including active circuit components 26, 28 that can preprocess the signals as by preamplifying them. The circuit board can also deliver signals to operate components in the transmission. The circuit board and a lower end of the connector are contained in a box 30 lying within the transmission mounting wall 20. Connections to the electrical connector can be made by a mating connector indicated at 32, which has contacts that mate with upper mating ends 34 of contacts 36 of the connector.

A common prior art approach to connecting a connector 12 to a circuit board 14, has been to provide plated-through holes in the circuit board. The lower or tail ends of the connector contacts 36 would project through such holes and be soldered in place thereat. Such contact through-hole connections provide reliable connections, but are costly, because of the cost of drilling and plating holes in the circuit board. It is possible to provide surface mount connections of the contacts to traces on the circuit board, wherein the lower ends of the contacts merely touch and are soldered to the traces. However, such surface mount connections are not as strong, and could be broken if there is any relative movement of one contact to another, as a result of large mating and unmating forces that separately push down and pull up the contacts. The present invention provides a surface mount connection which is reliable.

Figure 2:
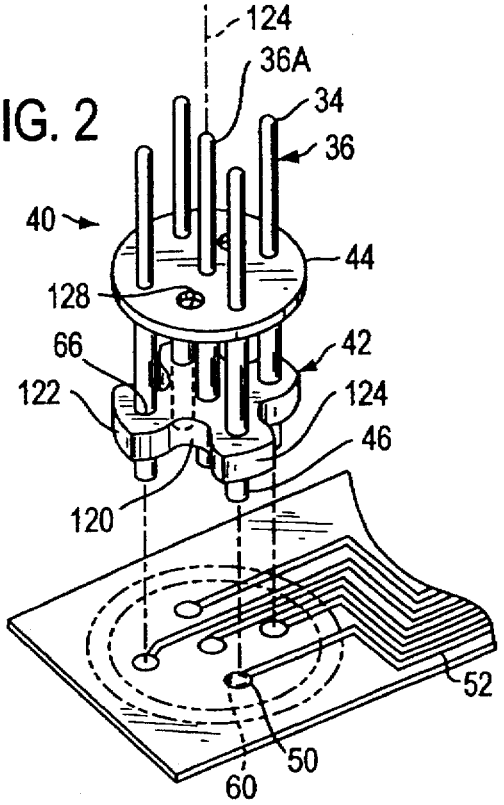
FIG. 2 is an exploded isometric view showing the connector-locator subassembly of FIG. 1 lying over a portion of a circuit board.

FIG. 2 shows a connector-locator subassembly 40 of the electrical connector, which includes the contacts 36, which are held in place by a dielectric locator 42. Where the contacts are long, an additional stabilizer 44 is provided. The contacts have inner or lower ends 46 that are designed to be soldered to contact pads 50 formed on circuit board traces 52.

Figure 7:
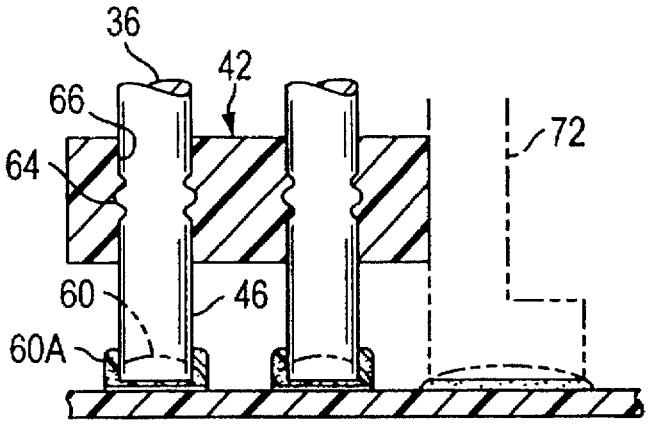
FIG. 7 is a partial sectional view of the subassembly of FIG. 2, initially installed but not yet soldered to the circuit board, and also showing, in phantom lines, a portion of the connector housing.
Figure 8:
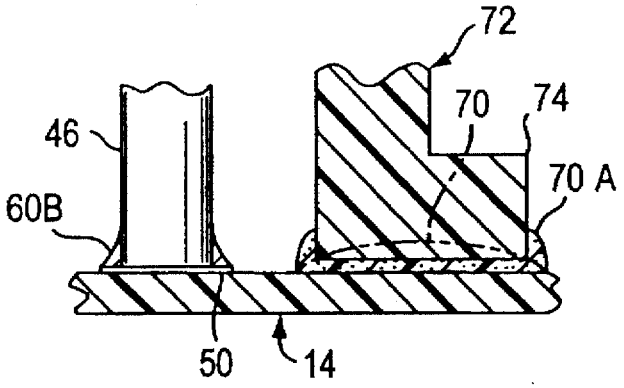
FIG. 8 is a view of a portion of the subassembly of FIG. 7 and of the connector housing, with both being fully installed, but with the potting compound not yet installed.
Figure 9:
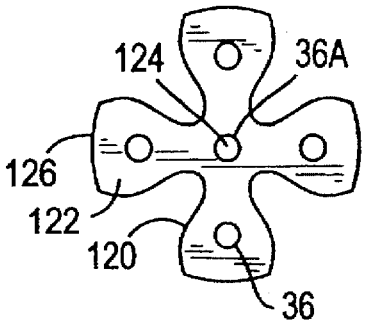
FIG. 9 is a view taken on line 9—9 of FIG. 3.

In a first step, drops or dollops 60 of solder paste are placed on each contact pad 50. Such solder paste has the consistency of tooth paste, and is readily applied by automated machinery to all contact pads of the circuit board, including those that will receive surface mount active circuit components. In FIG. 1, component 26 is an integrated circuit, while component 28 is a capacitor, resister, or inductor. All of such components are active circuit components, in that they substantially affect signals passing therethrough, as compared to inactive circuit components such as the traces or the connector contacts. FIG. 1 shows contact pads at 62 that also receive dollops of solder paste. After all solder paste dollops have been applied, the contacts of the circuit board components are pressed against the solder paste dollops, and the lower ends 46 of the connector contacts are pressed against the dollops 60 on the contact pads 50. The entire assembly of circuit board, components thereon, and the contact-locator subassembly 40 thereon, are reflow soldered, as by passing the apparatus through an oven. FIG. 7 shows the contacts 46 after they have been initially pushed down into the dollops 60, which are deformed to the shape 60A. FIG. 7 also shows that the contacts 36 have protrusion 64 that secure them within holes 66 in the locator when pressed therein. FIG. 8 shows the contact lower ends 46 after they have been reflow soldered to the contact pads 50, to form solder joints at 60B.

Figure 3:
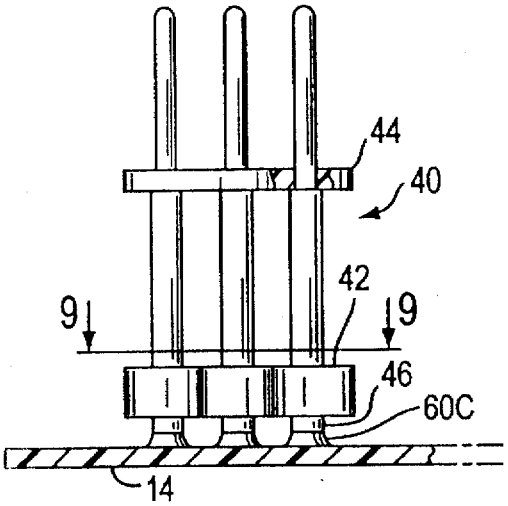
FIG. 3 is a partially sectional side view of the connector-locator subassembly of FIG. 2 shown mounted and soldered to the circuit board of FIG. 3, in a first step of the method of the invention.

FIG. 3 shows the connector-locator subassembly 40 with the contact lower ends 46 soldered at 60C to contact pads on the circuit board 14.

Figure 4:
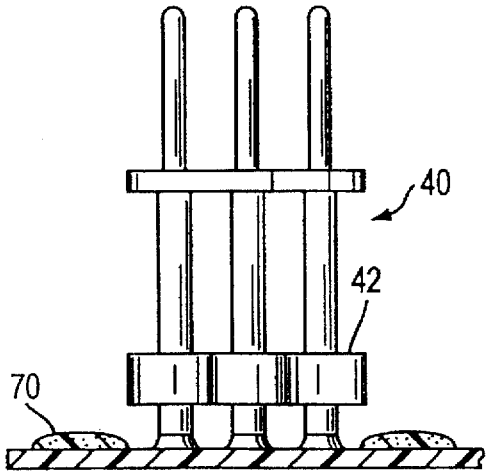
FIG. 4 shows the assembly of FIG. 3, with a loop of seal-adhesive applied to the circuit board, in a later step of the method.
Figure 5:
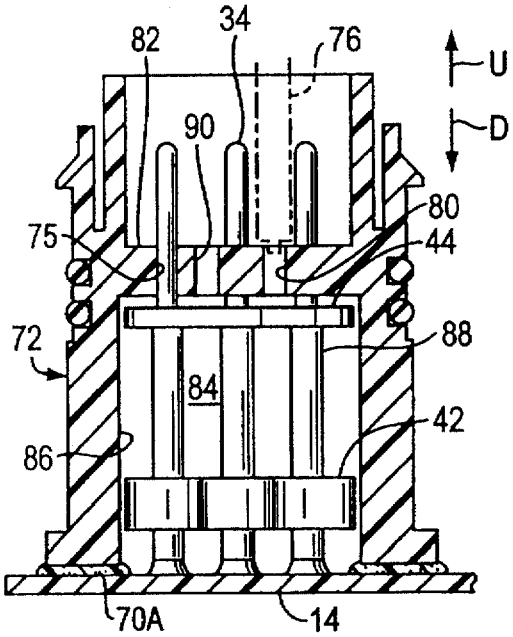
FIG. 5 shows the assembly of FIG. 4, with the connector housing having been moved down into place, in a later step of the method.

FIG. 4 shows that after the subassembly 40 has been soldered in place a loop or ring of seal-adhesive 70 is applied around the subassembly. As soon as the ring 70 of seal adhesive is applied, the connector housing shown at 72 in FIG. 5, is moved downwardly (direction D) around the locator 42, and against the deformed ring at 70A of seal adhesive, or sealing compound. The contact upper mating ends 34 project closely through holes 75 in an upper wall 82 of the housing. FIG. 8 shows that the ring 70 is deformed by the lower end 74 of the housing to the position 70A. The adhesive 70A is cured, as with ultraviolet light, or other adhesive curing means (heat, air, etc.). If the housing is not circular then the loop of sealing compound 70 is laid down in the shape of the periphery of the bottom of the housing.

After the housing has been located by the locator 42 and sealed to the circuit board 14, the apparatus is further treated as shown in FIG. 5, by applying a nozzle 76 to a hole or port 80 in an upper wall 82 of the connector housing. Then, a potting compound such as epoxy is pumped through the port 80 into an internal housing volume 84, which lies within housing vertical walls 85 that have an inner surface 86, and around lower portions 88 of the contacts and around the locator 42 and stabilizer 44. It is noted that a second hole or port 90 is provided in the connector upper wall 82, to permit the escape of air as the potting compound is pumped into the volume 84. The entire lower end 74 of the connector housing is preferably open to provide a wide area of contact of the sealing compound with the circuit board.

Figure 6:
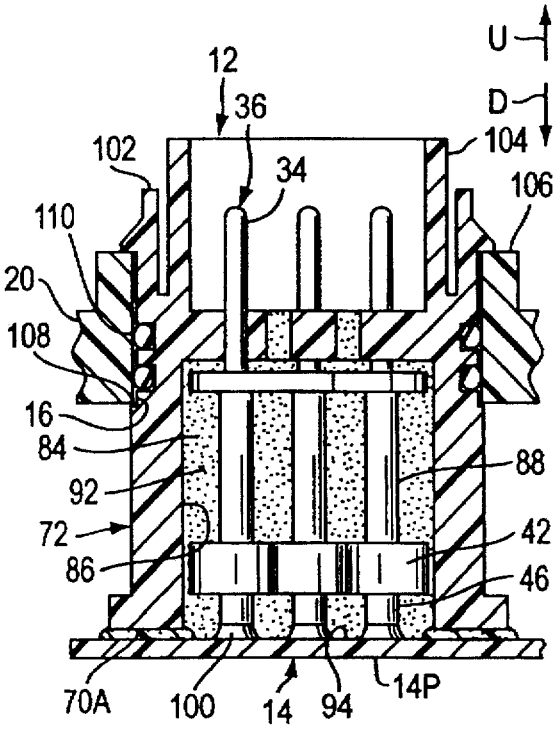
FIG. 6 is a view of the assembly of FIG. 5, with potting compound having been injected into the housing and cured, and with the housing mounted on a mounting wall, in later steps of the invention.

FIG. 6 shows the volume 84 completely filled with a quantity 92 of potting compound. The potting compound adheres to the inner surface or walls 86 of the connector housing, to the lower portions 88 of the contacts, and to an upper surface 94 of the portion 14P of the circuit board that lies under the connector. The potting compound is allowed to harden, so it holds the circuit board securely to the contacts and to the connector housing. The potting compound preferably become rigid when cured, and may be epoxy. The potting compound prevents movement of the lower ends of the contacts with respect to the circuit board, even when large mating and unmating forces are applied to the upper pin ends 34 of the contacts 36. Also, the potting compound provides wide area of adhesion of the circuit board to the connector housing and contacts. Such reliable secure holding of the circuit board to the connector housing and contacts, helps assure that the solder joints at 100, which include solder filets (60B in FIG. 8), will remain reliably intact throughout a long life of use of the connector.

FIG. 6 shows that the connector housing 72 includes snap looks 102 that allow the upper portion 104 of the housing to be inserted upwardly (U) through the vertical aperture 16 in the mounting wall 20, until the locks snap against an upper surface 106 of the wall. At that time, a shoulder 108 of the connector housing abuts a lower surface of the mounting wall. O-rings 110 seal the aperture. As a result of such mounting, the connector and the circuit board portion 14P are supported on the mounting wall 20. Where the circuit board is flexible, another portion can be support on the box 30 (FIG. 1).

The locator 42 is formed with a plurality of cutouts or spaces 120 that leave leaves 122 that are circumferentially spaced apart, with respect to the axis 124 of the subassembly and of the connector. The spaces 120 facilitate visual inspection of the solder joints, especially of the solder joint of the centermost contact 36A. As circular connectors, the contacts are arranged in one or more concentric circles, the inner circle of the subassembly of FIG. 2 lying on the axis 124. In other connectors, which may have up to 24 or more contacts, the leaves are especially useful to enable visual inspection of welds at each of the contacts. It is noted that despite the leaves, the locator has peripheral surface portions at 126 which lie on a circle concentric with the axis 124, to guide the connector housing into place down against the adhesive on the circuit board. It may be noted that the stabilizer 44 (FIG. 2) can be provided with holes at 128, to facilitate the passage of the potting compound.

Figure 10:
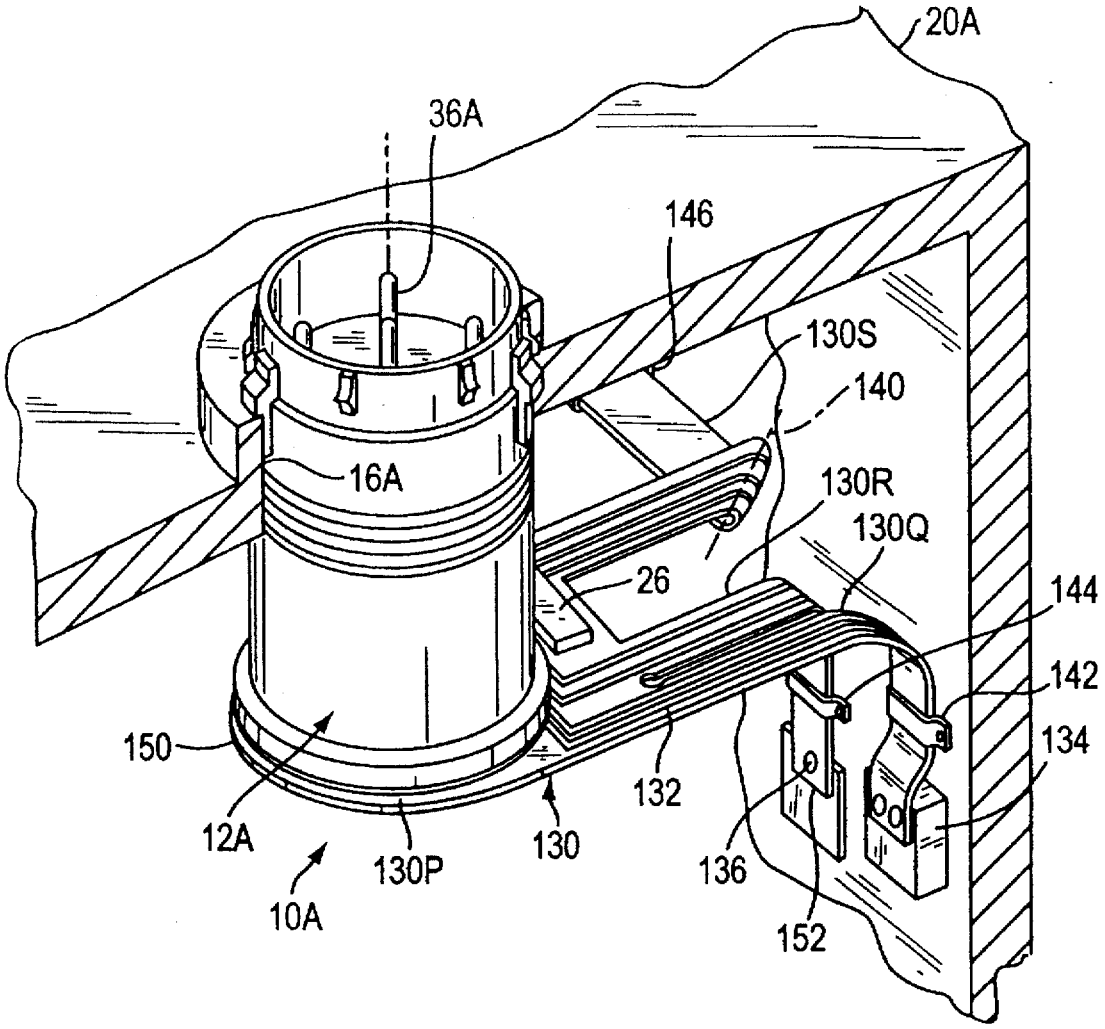
FIG. 10 is a sectional isometric view of a connector-board assembly mounted on a mounting wall, in accordance with another embodiment of the invention.

FIG. 10 illustrates another connector board assembly 10A which includes an electrical connector 12A that is the same as the connector 12 in FIGS. 1–9, and a circuit board 130. The connector 12A is mounted in an aperture 16A of a rigid mounting wall 20A that may be part of an automatic transmission and that may be of the same construction as the mounting wall 20 of FIGS. 1–9. The circuit board 130 has an inner portion 130P that is surface mounted to contacts 36A of the connector in the same manner as in FIGS. 1–9. However, the circuit board has other portions 130Q, 130R, and 130S that act like wires to connect to electrical components in the transmission case formed by the wall 20A. In particular, the circuit board is shown as having a first elongated bent portion 130Q that contains traces 132 and that extends to an actuator 134 to energize it. One example of such actuator is one that shifts the positions of a gear to change the gear ratio of the transmission. A second elongated and bent circuit portion 130R extends to a sensor 136 that senses temperature, such as of transmission fluids. A third elongated bent circuit board portion 130S can extend to other components such as a position sensor that senses the position of a gear to determine the particular state of the transmission.

The third elongated flexible circuit board portion 130S is shown as having a bend along the axis 140, which shows that the flexible circuit board can reach many positions within the housing formed by the wall 20A. It is noted that the flexible circuit portions 130Q, 130R, 130S are supported by ties 142, 144, 146 to fix their positions adjacent to the walls of the transmission, so they will not engage moving parts. The flexible circuit board 130 can be formed of polyamide, which is highly resistant to oil and to moderately elevated temperatures such as those encountered in a vehicle transmission. The board can have a coating over much of the traces such as 132 to prevent short circuiting. The flexible circuit board is resilient, so it does not hold kinks in its bends, and its position is easily reliably maintained. The entire circuit board, between its extreme ends such as at 150 and 152 may have a length of one-quarter to one-half meter, with the thickness of the circuit board being about one-third to one-half millimeter. It is noted that in previous transmissions, many individual wires typically extended from the lower end of the connector such as 12A, with each wire connected to a distant circuit board or to individual electrical components in the transmission. Applicant's use of a flexible circuit board, allows connector contacts to be easily connected to a circuit board, and facilitates connection to distant sensors, activators, or other components, by connection through bent portions of the circuit board.

While terms such as "vertical", "up", "lower", etc. have been used to aid in describing the invention as illustrated, the invention and its parts can be positioned at any orientation with respect to the Earth.

Thus, the invention provides a connector-board assembly that includes surface mount connector contacts, which provides secure solder joints between the contacts and circuit board traces, and provides a method for assuring this. A quantity of potting compound lies in the connector housing and is bonded to it, to the contacts, and to the circuit board, to prevent relative movement of the contacts to the circuit board and thereby assure reliable solder joints and secure holding of the circuit board. The connector can be mounted on a rigid mounting wall with a vertical aperture therein, so the connector is mounted on the mounting wall, and the circuit board is held, through the connector, at a fixed location relative to the mounting wall. The connector includes a connector-locator subassembly whose contacts are initially soldered to traces on the circuit board. Then, a sealing adhesive is applied and the connector housing is lowered closely around the locator of the subassembly and adhered to the circuit board. Thereafter, potting compound is pumped through a hole into the connector, with the sealing material lying between the housing and circuit board preventing escape of the potting compound. The locator of the subassembly preferably has cutouts in its periphery, to facilitate viewing of the solder joints, but has peripheral locations lying on a circle or cylinder, to closely position the connector housing.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector-board assembly that can mate to a connector, comprising:

a circuit board having a first portion with an upper face that carries a plurality of conductive traces, with said upper face lying in a horizontal plane;

a plurality of connector contacts having upper ends for mating to said connector and having lower ends that are each soldered to one of said traces;

a connector housing that has an upper wall with contact-passing holes through which said contacts extend and that has vertical walls that extend completely around said contacts, said housing vertical walls extending vertically from said upper housing wall to substantially said circuit board upper face and said housing vertical walls being bonded to said circuit board upper face, with said housing vertical walls having an inner surface;

a quantity of potting compound lying in said housing and bonded to said inner surface of said housing vertical walls, to said contacts, and to said upper face of said circuit board.

2. The assembly described in claim 1 including:

a rigid mounting wall that has a vertical through aperture, said connector housing being mounted on said mounting wall in said aperture to prevent upward or downward movement of said connector housing thereon, with said contacts having upper mating ends that are accessible from above said mounting wall, with mating and unmating forces applied to said contacts being transferred from said contacts through said potting compound and through said connector housing to said mounting wall, and with said first portion of said circuit board held through said potting compound and said connector housing to said mounting wall.

3. A connector-board assembly comprising:

a rigid mounting wall that has a vertically-opening wall aperture;

a connector that includes a connector housing that is mountable in said wall aperture and held therein against up and down and sideward movement, said housing having a lower end;

said connector includes a plurality of vertically-extending contacts with upper mating ends accessible from above said mounting wall and with lower ends lying at substantially the same height as said connector lower end, and also includes an insulator that locates said contacts and fixes them in said connector housing;

a circuit board with a first portion lying under said contact lower ends, said circuit board first portion having a plurality of traces forming contact pads that are each soldered to one of said contact lower ends, with said circuit board first portion being supported through said contact lower ends, said connector housing, and said mounting wall.

4. The assembly described in claim 3 wherein:

said circuit board is a flexible circuit board that includes second and third board portions that are integral with said first board portion and that extend in different paths away from said first board portion, with said second and third board portions each carrying at least one elongated trace and being bent.

5. The assembly described in claim 3 wherein:

said housing lower end is adhesively bonded to said circuit board around said contact lower ends, with said circuit board portion also being directly supported on said housing.

6. The assembly described in claim 5 including:

a quantity of potting compound lying around and bonded to said contacts and bonded to said housing to fix them together, said housing lower end being open and said potting compound extending to said housing open lower end and being bonded to said circuit board.

7. Connector apparatus that can be assembled with a circuit board that has contact pads, comprising:

a locator of dielectric material having a plurality of vertical locator holes therein;

a plurality of pin contacts that each projects through one of said holes and that is fixed thereat to said locator, said pins having lower ends lying in a common horizontal plane for soldering to said circuit board contact pads;

a connector housing which has a housing lower end and which is constructed to slide downwardly closely around said locator until said housing lower end is substantially even with said common horizontal plane, said housing having an upper horizontal wall with a plurality of housing holes for passing upper ends of said pin contacts;

said connector housing having a port for passing potting material to a region under said upper wall, to pot at least said locator and an inside surface of said housing that lies under said upper wall, to each other and to the circuit board.

8. The apparatus described in claim 7 wherein:

said pin contacts are arranged to lie on at least one circle and said locator is largely plate shaped and has a center and has a plurality of leaves circumferentially spaced about said center with each of said vertical locator holes extending through one of said leaves and with said locator having a circumferential space between each pair of adjacent leaves.

9. A connector-board assembly comprising:

a circuit board having a first portion with a plurality of conductive traces thereon;

a plurality of connector contacts having lower ends that are each soldered to one of said traces;

a connector housing that extends around said contacts and that has housing inner walls;

a quantity of potting compound lying in said housing and bonded to said housing inner walls, to said contacts, and to said first portion of said circuit board;

a locator formed of insulative material and having a plurality of vertical holes, with said contacts extending through said holes and fixed in position thereat, independently of said potting material, and with said connector housing engaging and being horizontally located by said locator;

said housing has an open lower end with a peripheral lower end wall that extends around said contact lower ends and that lies substantially against said circuit board, and including a quantity of sealing material sealing said housing lower end wall to said circuit board.

10. A connector-board assembly comprising:

a circuit board having a first portion with an upper face that lies in a horizontal plane and that carries a plurality of conductive traces;

a plurality of connector contacts having upper ends, and having lower ends that are each soldered to one of said traces;

a connector housing (72) that has vertical walls that extend around said contacts and that are mounted on said circuit board, with said vertical walls having inner surfaces;

a locator (42) formed of insulative material and having a plurality of vertical holes, with said contacts extending through said holes and fixed to said locator thereat, and with said inner surfaces of said connector housing vertical walls lying closely around and being horizontally located by said locator, but with said locator being free of vertical abutment against said connector housing so the vertical position of said connector housing is independent of the vertical position of said locator.

* * * * *